US007046985B2

(12) United States Patent
Seales et al.

(10) Patent No.: US 7,046,985 B2
(45) Date of Patent: May 16, 2006

(54) SECURITY SYSTEM

(75) Inventors: Todd Z. Seales, Pontotoc, MS (US); Michael L. Watson, Pontotoc, MS (US); John Davison Richardson, Alpharetta, GA (US); Peter A. Cascio, Lawrenceville, GA (US); Steve Cain, Lawrenceville, GA (US); Michael G. Ellis, Sr., Alpharetta, GA (US); John N. Martin, Alpharetta, GA (US)

(73) Assignee: Talk Emergency, LLC, Pontotoc, MS (US)

( * ) Notice: Subject to any disclaimer, the term of this patent is extended or adjusted under 35 U.S.C. 154(b) by 0 days.

(21) Appl. No.: 10/401,476

(22) Filed: Mar. 28, 2003

(65) Prior Publication Data

US 2003/0184436 A1 Oct. 2, 2003

Related U.S. Application Data

(60) Provisional application No. 60/369,262, filed on Apr. 2, 2002.

(51) Int. Cl.
*G08B 1/00* (2006.01)

(52) U.S. Cl. ..... 455/404.1; 455/404.2; 340/506; 340/531; 340/541

(58) Field of Classification Search ..... 455/404.1, 455/404.2, 414.1, 426.1, 554.2, 41.2, 428; 340/506, 531, 541; 725/105; 348/143
See application file for complete search history.

(56) References Cited

U.S. PATENT DOCUMENTS

| | | | | |
|---|---|---|---|---|
| 4,792,946 | A * | 12/1988 | Mayo | 370/245 |
| 5,103,206 | A * | 4/1992 | Yu | 340/506 |
| 5,686,886 | A * | 11/1997 | Stensney | 340/539.14 |
| 5,745,849 | A * | 4/1998 | Britton | 455/404.1 |
| 6,243,010 | B1 | 6/2001 | Addy et al. | |
| 6,288,642 | B1 * | 9/2001 | Dohrmann | 340/540 |
| 6,337,621 | B1 | 1/2002 | Ogino et al. | |
| 6,445,291 | B1 * | 9/2002 | Addy et al. | 340/539.22 |
| 6,559,765 | B1 * | 5/2003 | Tsuzuki et al. | 340/506 |
| 6,624,750 | B1 * | 9/2003 | Marman et al. | 340/506 |
| 6,636,732 | B1 * | 10/2003 | Boling et al. | 455/404.1 |
| 6,650,871 | B1 * | 11/2003 | Cannon et al. | 455/41.2 |
| 6,690,411 | B1 * | 2/2004 | Naidoo et al. | 348/143 |
| 6,829,478 | B1 * | 12/2004 | Layton et al. | 455/428 |
| 2001/0029187 | A1 | 10/2001 | Cannon et al. | |
| 2002/0167590 | A1 | 11/2002 | Naidoo et al. | |

* cited by examiner

*Primary Examiner*—William Trost
*Assistant Examiner*—Brandon J. Miller
(74) *Attorney, Agent, or Firm*—Needle & Rosenberg, PC

(57) ABSTRACT

A security system and method in which a base unit at a monitored premises such as a residence can, when its alarm is activated by, for example, the detection of an intrusion, fire or other emergency, establish radio communication with similar base units or compatible devices at residences within the same neighborhood and transmit voice and other audio information to alert them of the activation of the alarm.

27 Claims, 10 Drawing Sheets

SECURITY SYSTEM

CROSS-REFERENCE TO RELATED APPLICATION

The benefit of the priority of U.S. provisional patent application Ser. No. 60/369,262, filed Apr. 2, 2002, entitled "Talk Emergency System," is hereby claimed, and the specification thereof incorporated herein in its entirety by this reference.

BACKGROUND OF THE INVENTION

1. Field of the Invention

The present invention relates generally to residential alarm or security systems and, more specifically, to such systems that provide voice communication between the monitoring service and the monitored premises and involve radio communication.

2. Description of the Related Art

Security systems, also referred to as alarm systems, monitor a home or other premises against intrusion as well as fire or other emergency. When the alarm is activated, the base unit in the monitored premises telephones a monitoring service and transmits codes to indicate that a break-in or other emergency has been detected. Some alarm systems transmit to a monitoring service via radio. Alarm systems can have contact sensors to detect opening of doors and windows, glass-breakage sensors, and infrared or ultrasonic motion detectors. Triggering of any of these sensors activates the alarm. Some security systems have so-called panic buttons by which an occupant of the monitored premises can manually activate the alarm. In some alarm systems, the panic button is on a pendant that an occupant of the monitored premises can wear around his or her neck or otherwise carry. The pendant transmits a signal to the base unit if the wearer activates the panic button.

In response to the telephone call, personnel at the monitoring station can telephone the premises at which the call originated and attempt to speak with an occupant to verify the nature of the emergency. The monitoring service personnel may request that the occupant say a secret code to indicate that the occupant is a person authorized to speak with the monitoring service. The monitoring service may dispatch emergency personnel, such as police, to the premises. If the person states that the alarm was triggered inadvertently, and the code matches one the monitoring service has on file for that premises, the monitoring personnel may log the incident as a false alarm and take no further action.

Some alarm systems have a voice transmission feature. When the alarm is activated, microphones in the premises pick up any voices or noises in the vicinity, which the base unit transmits to the monitoring service to help monitoring personnel ascertain the nature of the emergency.

A deficiency in such prior alarm systems is that the process of alerting monitoring personnel and dispatching emergency personnel such as police to the premises can be relatively slow. Furthermore, telephone lines, through which most commercially available alarm systems provide communication between the base units and monitoring station, are susceptible to being cut or otherwise disabled by persons intent upon isolating the premises to avoid being detected. Although some alarm systems may have the capability to avoid reliance upon telephone lines by providing radio communication, such systems are uncommon. Moreover, in a small percentage of instances, personnel at a remote monitoring station fail to take proper action to handle the emergency.

It would be desirable to provide an alarm system that minimizes reliance upon a central monitoring service and that promotes the rapid arrival of help to the monitored premises. The present invention addresses this problem and others in the manner described below.

SUMMARY OF THE INVENTION

The present invention relates to a security system and method in which a base unit at a monitored premises such as a residence can, when its alarm is activated by, for example, the detection of an intrusion, fire or other emergency, or an occupant of the monitored premises pressing a "panic" button, establish radio communication with similar base units or compatible devices at residences within the same neighborhood and transmit voice audio information to alert them of the activation of the alarm. In some embodiments of the invention, the transmitted audio information can include the occupant's call for help or other voices or noises from within the monitored premises received via a microphone. Alternatively, or in addition, the voice information can include a predetermined message that, for example, identifies to the listener the address of the premises at which the alarm was activated. A base unit can also communicate with a remote monitoring station and, in some embodiments of the invention, transmit such voice information to monitoring personnel at the station. Embodiments of the invention can include a pendant or similar personal emergency device by which an occupant of the premises can manually activate the alarm. Embodiments can additionally or alternatively include one or more movement detection units that can be mounted on movable personal property such as items on the grounds outside a house. In some embodiments of the invention, the base unit can be remotely programmed.

It is to be understood that both the foregoing general description and the following detailed description are exemplary and explanatory only and are not restrictive of the invention, as claimed.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION

Figure 1:
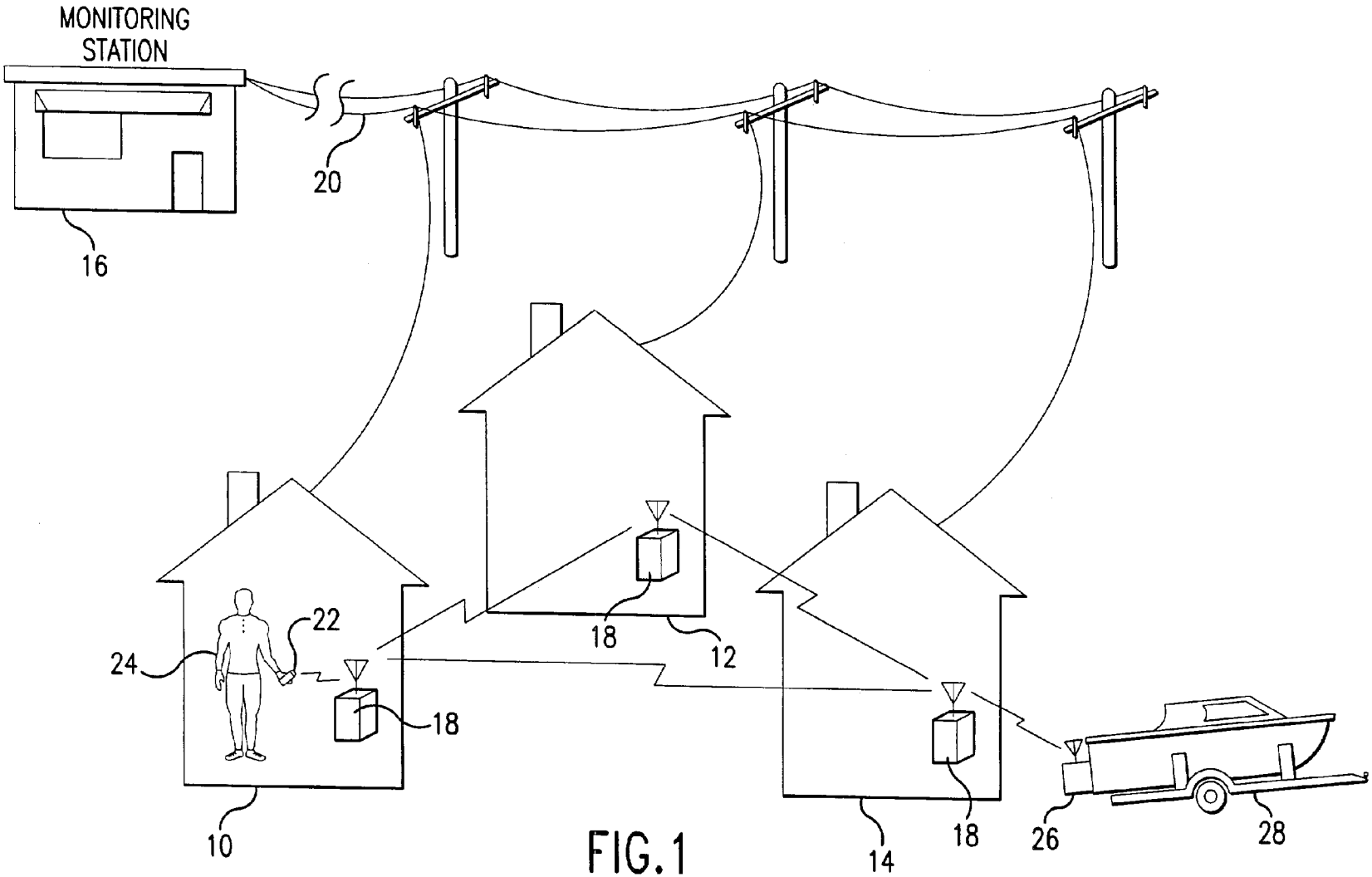
FIG. 1 illustrates a security system used in a neighborhood or community of residences.

In the exemplary embodiment of the invention illustrated in FIG. 1 (not to scale), a number of homes 10, 12 and 14 in a neighborhood have security systems installed therein that are remotely monitored at a monitoring station 16 pursuant to a monitoring service arrangement to which the owners of homes 10, 12 and 14 subscribe and pay a fee (e.g., monthly or yearly). Each security system (also referred to as an alarm system) includes a base unit 18 and, in addition to the novel features described below, can detect home intrusions (also referred to as break-ins), fires, and any other emergency event that it is known in the art to which the invention relates for home security systems to detect. Accordingly, a security system can include, in addition to base unit 18, any suitable type and number of sensors (not shown for purposes of clarity) for detecting such events, such as perimeter contact switches for doors and windows, glass breakage detectors, and infrared and ultrasonic motion detectors. In addition or alternatively, one or more so-called "panic buttons" (similarly not shown) are included in the security system that an occupant can manually press or otherwise activate. The sensors, panic buttons and other such activation devices are in communication with activation inputs of base unit 18. Panic buttons can be integral to base unit 18 or, alternatively or in addition, remotely located from base unit 18, as described in further detail below.

When an activation device detects an emergency event, base unit 18 activates the alarm. Alarm activation can include, in addition to the actions described below, any suitable action known in the art, such as alerting monitoring station 16 via telephone lines 20 or a radio link (not shown). In some embodiments of the invention, base unit 18 can be armed, i.e., set to monitor for an emergency event, and disarmed remotely as described below. Nevertheless, in other embodiments of the invention it can be armed and disarmed in a manner more or less conventional for alarm systems, such as by a homeowner or other authorized person entering a secret code on a keypad (not shown).

A security system can further include, in addition or alternatively to the above-described features, a personal emergency device, which may be referred to for convenience as a pendant 22 because it can, in some embodiments of the invention, be embodied in a portable package that can be worn as a necklace pendant or carried as a keychain fob or pendant by a homeowner or other occupant 24 of the monitored premises, or otherwise conveniently and unobtrusively carried and activated (e.g., with only one hand). Pendant 22 and its operation in the system as an alarm activation device are described below.

A security system can further include, in addition or alternatively to the above-described features, one or more movement detection units 26 that can be mounted on personal property 28, such as a boat trailer, in the vicinity of the monitored home. When personal property 28 is moved, a movement detection unit 26 signals base unit 18 by transmitting a radio signal or by other suitable means. Movement detection unit 26 and its operation in the system as an alarm activation device are described in further detail below.

An action that can occur in response to alarm activation is to alert neighbors of the emergency. As described below in further detail, each base unit 18 can initiate radio communication, which, as described below, can be two-way communication, with one or more other base units 18. For example, if an alarm activation occurs in the security system installed in home 10, base unit 18 in home 10 transmits a signal that can be received by base units 18 in homes 12 and 14, i.e., homes in the same neighborhood or vicinity. Likewise, if an alarm activation occurs in the security system installed in home 12, base unit 18 in home 12 transmits a signal that can be received by base units 18 in homes 10 and 14. Similarly, if an alarm activation occurs in the security system installed in home 14, base unit 18 in home 14 transmits a signal (e.g., voice and recorded message, as described below) that can be received by base units 18 in homes 10 and 12. There can be any suitable number of homes in which base units 18 can communicate with each other in this manner to alert persons in the neighborhood of an emergency occurring at a neighbor's home in a "neighborhood watch"-like manner.

As described in further detail below, a base station 18 can transmit sound or audio information, such as a pre-recorded message, or a person's voice or noises occurring in the house, to monitoring station 16 or, alternatively or in addition, to other base stations 18 in the neighborhood. In other words, in some embodiments of the invention base station 18 can transmit such audio information to other base stations 18, in other embodiments it can transmit Such audio information to monitoring station 16, and in still other embodiments it can transmit to both. Embodiments of the invention are also contemplated in which it can be selected through software programming whether a base station 18 transmits to monitoring station 16, other base stations 18, or both.

Figure 2:
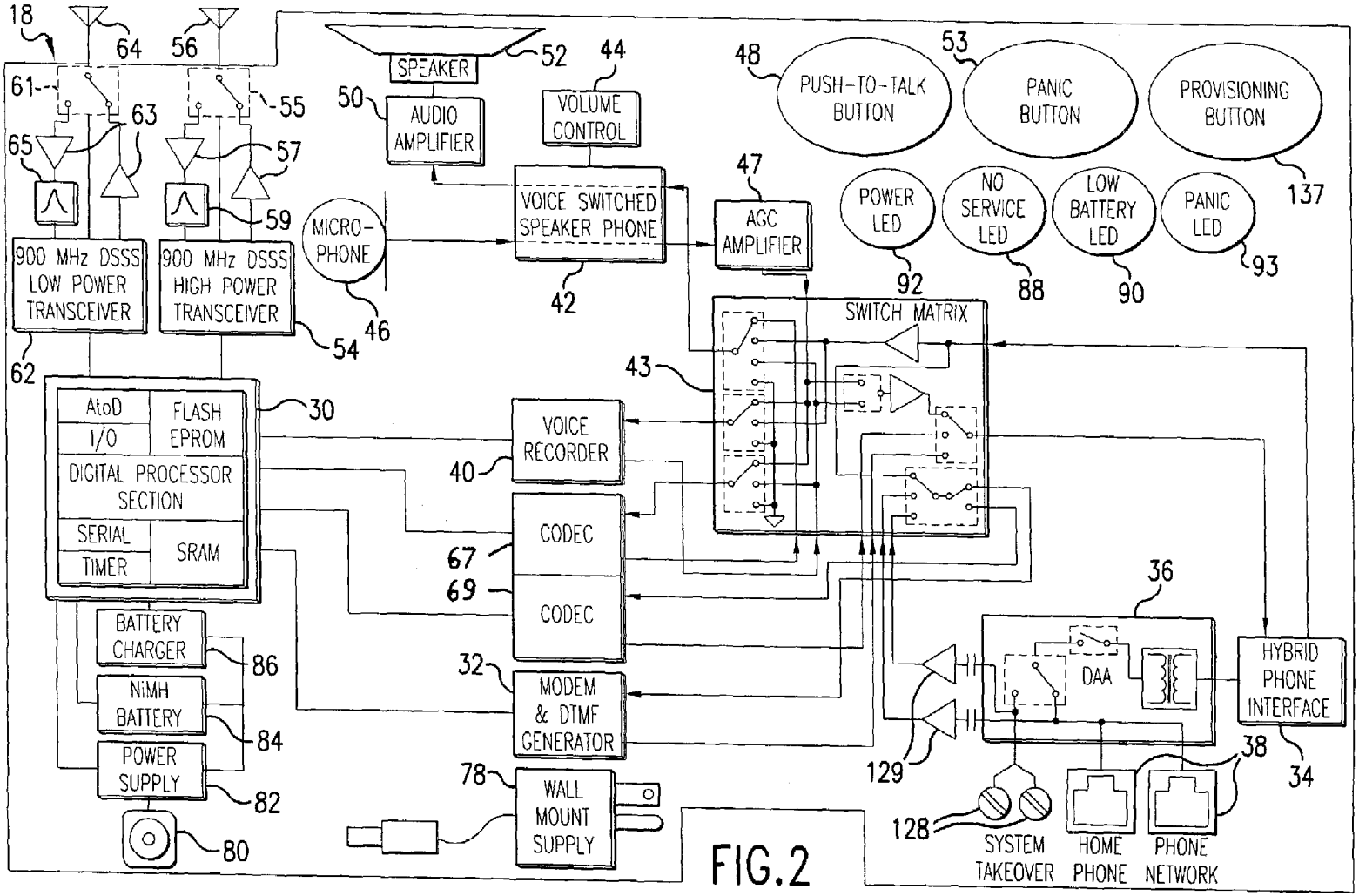
FIG. 2 is a block diagram of a base unit of the security system.

As illustrated in FIG. 2, in the illustrated embodiment of the invention a base station 18 can operate under the control of a digital processor 30 that can be programmed or other suitable digital logic that can be programmed or adapted to effect the operating methods described herein. A suitable digital processor 30 is the Motorola DSP56858FV120, which includes non-volatile flash EPROM, SRAM, input/output interfaces, serial interfaces, a timer, and analog-to-digital converters. Also, as described below, activation parameters that enable, disable and configure specific features can be downloaded. Storing activation parameters downloaded into base unit 18 in non-volatile flash memory allows them to be readily changed and yet prevents their loss in the event electrical power is removed from base unit 18. As with conventional residential remotely monitored security systems, so-called "Contact ID" tone signals can be communicated between base unit 18 and monitoring station 16 (FIG. 1) via a telephone connection. Contact ID tones and their use in security systems are well known in the art and therefore not described in this patent specification. Alternatively or in addition to Contact ID, DTMF or any other suitable encoding scheme known in telephone-based data communications can be used. Provided for this purpose are a modem and DTMF generator circuit 32, a hybrid telephone line interface 34, data access arrangement (DAA) devices 36, and RJ-11 jacks 38. When base unit 18 is installed in a home, a cable (not shown) plugs into one of jacks 38 and the wall jack (not shown) to connect base unit 18 to the public switched telephone network. The other of jacks 38 can be used to connect a telephone (not shown).

Base unit 18 has alarm activation inputs that can receive activation signals from activation devices such as a panic button 53, door and window switches (not shown for purposes of clarity), and any other activation devices known in the art. Indeed, as described below in connection with another feature of the invention, base unit 18 can be activated in response to these signals received indirectly through an entirely different security system base unit (not shown) that a homeowner may have been using before installing base unit 18. This feature may be referred to as "system takeover."

Elements of base unit 18 relating to voice and other audio transmission include a voice recorder 40, a voice-switched speakerphone circuit 42, a switch matrix 43, a volume control 44, a base unit microphone 46, an AGC amplifier 47, a push-to-talk switch or button 48, an audio amplifier 50 and a speaker 52. Digital direct sequence spread-spectrum (DSSS) radio transceivers 54 and 62, operable in a suitable frequency band such as the 900 MHz (more accurately, 902–928 MHz) Instrument-Scientific-Medical (ISM) band in which common household cordless telephones are known to operate, enable two-way radio communication with other base units 18 that may be installed in neighbors' homes (see FIG. 1). An antenna 56 is coupled to transceiver 54 via a transmit/receive switch 55, a power amplifier pair 57 and a filter 59. Another antenna 64 is coupled to transceiver 62 via another transmit/receive switch 61, a power amplifier pair 63 and a filter 65. Such transceivers are economical because they are readily commercially available, in many cases as a single integrated circuit chip, from a number of sources involved in the cordless telephone industry and are approved for such use in the United States by the Federal Communications Commission (FCC). They typically have a range of several hundred meters, which is sufficient to communicate with one or more other base units 18 within a typical residential neighborhood. A chip pair that is suitable for each of transceivers 54 and 62 is the ML2722, available from Micro Linear, Inc. of San Jose, Calif., and the SS1101C from Siliconians, Inc. of Los Altos, Calif. A CODEC 67 converts analog voice information originating with base unit microphone 46 or voice recorder 40 into digital data for transmission via transceiver 54 or 62. When a transmission is received by transceiver 54 or 62, the digital data is sent to CODEC 67, which converts the digital data into analog voice information destined for speaker 52, voice recorder 40 or transmission over the telephone line to monitoring station 16. CODEC 69 can perform the same function described for CODE 67, or, alternatively or in addition, digital processor 30 can, depending upon its programming, use CODEC 69 to replace or augment functions such as DTMF, modem or similar type functions. As described below, switch matrix 43 routes these signals between such origins and destinations under the control of digital processor 30.

A potential difficulty that has been overcome in embodiments of the invention in which the radio transceiver is of the above-described 900 MHz ISM-band spread spectrum cordless telephone-type, is that commercially available products that include such transceivers, such as cordless telephones, are not designed to accommodate voice transmission to multiple receivers. Such transceivers operate in half-duplex mode and can simulate full-duplex by time-slicing the transmissions. In other words, when two parties are speaking with each other through respective first and second cordless telephone transceivers (e.g., one in the telephone handset and the other in the telephone base), bursts of digitized audio transmitted from the first transceiver are interlaced with those transmitted from the second transceiver so that it appears to the parties as though they can speak simultaneously, i.e., full-duplex, as in a conventional wire-based telephone connection. A transceiver transmits each successive signal burst in response to receipt of a signal burst from the other in a ping-pong like manner. This simulated full-duplex communication presents a potential difficulty in the "neighborhood watch" context of the present invention for at least two reasons: If the first transceiver "pings" by transmitting a burst, but the second transceiver does not respond by "ponging" with a burst of its own, the first transceiver will only continue to ping for a few more tries before ceasing. Also, if the first transceiver pings by transmitting a burst, and multiple other transceivers respond by ponging with bursts of their own, the first transceiver will be unable to resolve which transceiver responded. These problems may be referred to for convenience as relating to the "ping-ponging" operation that characterizes the voice communication mode in which such transceivers generally operate.

To alleviate these potential ping-ponging problems, transceiver 54 can be set up or configured to operate in a half-duplex data mode rather than the more common voice mode. Most commercially available ISM-band transceivers used in cordless telephones have two modes: voice and data. Although such transceivers can be configured to operate in one or the other mode, only voice mode is commonly selected in cordless telephone designs. In data mode, transceivers 54 and 62 can continue to transmit data despite the absence of a responsive "pong" and despite multiple "pongs" from other base units 18. With transceivers 54 and 62 in data mode, digital processor 30 directs digitally-encoded audio information, such as voice received via microphone 46 or a pre-recorded informational message that is stored in voice recorder 40, through the audio input sections of the circuitry to transceivers 54 and 62.

Figure 3:
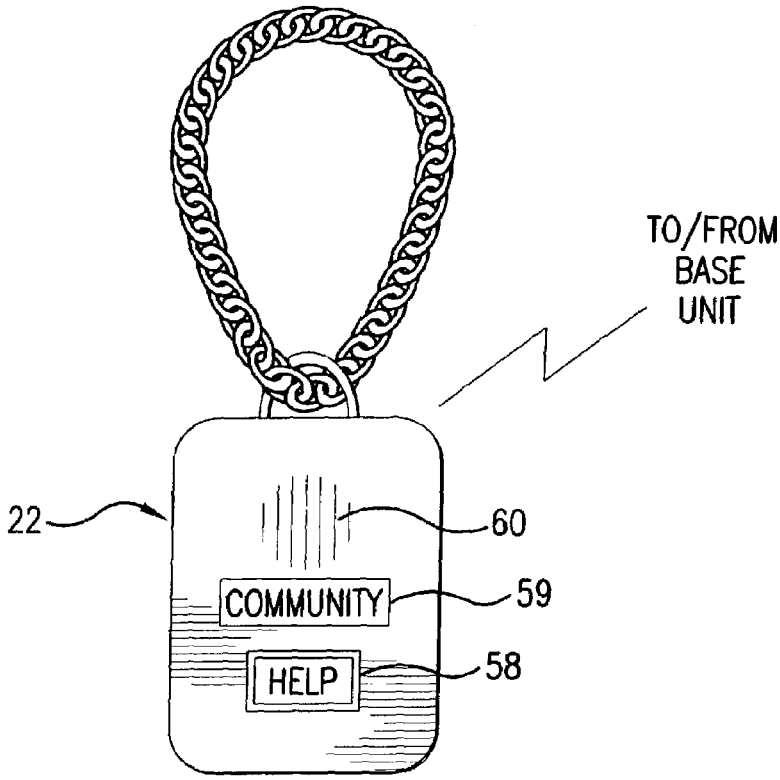
FIG. 3 illustrates an emergency pendant.

Pendant 22 is illustrated in FIG. 3 in further detail. It includes a panic button 58 that an occupant of the monitored home can press to activate the alarm. In some embodiments of the invention it can, alternatively or in addition, include a microphone 60 that the person can speak into to summon help or provide other information. Circuitry internal to pendant 22 is not shown for purposes of clarity but includes a suitable DSSS radio transceiver capable of communicating with transceiver 62 in base unit 18.

In some embodiments of the invention, in addition or alternatively to Panic button 58, pendant 22 can include a Community button 59 that the occupant can press while speaking into microphone 60. In such embodiments, pressing Panic button 58 causes pendant 22 to transmit a signal to base unit 18 to which base unit 18 responds by in turn establishing communication links with other base units 18 within the neighborhood or community, i.e., within radio reception range, as well as establishing a communication link with monitoring station 16. Audio received via microphone 60 can be communicated via these links. In the illustrated embodiment of the invention, links between base units 18 are radio communication links, and links with monitoring station 16 are telephone line links, though in other embodiments of the invention these communication links can both be radio links or any other suitable media. The person who pressed Panic button 58 can summon help from personnel at monitoring station 16 as well as from neighbors in the community by speaking into microphone 60. Pressing Community button 59 causes pendant 22 to transmit a signal to base unit 18 to which base unit 18 responds by in turn establishing communication links with other base units 18. Nevertheless, base unit 18 does not establish a communication link with or otherwise alert monitoring station 16 in response to the pressing of Community button 59. In summary, Community button 59 is intended to be used to summon help from neighbors in less serious emergencies, whereas Panic button 58 is intended to be used to summon help from both neighbors and monitoring service personnel in more serious emergencies. Nevertheless, the features of the security system of the present invention are flexible and can be used in any suitable manner for any suitable purpose.

As illustrated in FIG. 2, a transceiver 62 capable of communicating with that of pendant 22 is included in base unit 18 and coupled to an antenna 64. Digital processor 30 can, depending upon its programming in a given embodiment of the invention, direct the audio information received from pendant 22 to transceiver 54 for radio transmission to other base units 18 or, alternatively or in addition, to monitoring station 16 (FIG. 1) via a telephone line connection, as described in further detail below with regard to the method of operation.

Digital processor 30 can, depending upon its programming in a given embodiment of the invention, direct a pre-recorded message stored in voice recorder 40 to transceiver 54 for radio transmission to other base units 18 or, alternatively or in addition, to monitoring station 16 (FIG. 1) via a telephone line connection, as described in further detail below with regard to the method of operation. In addition to storing pre-recorded messages, voice recorder 40 can store or record voice or noises received via microphone 46 or pendant 22.

When the user presses a Talk button 48 on base unit 18, switch matrix circuit 43, under control of digital processor 30, routes the audio signal received via microphone 46 to voice recorder 40 for recording or to transceiver 54 for transmission to other base units 18. When the user presses a Panic button 53 on base unit 18, switch matrix circuit 43, under control of digital processor 30, routes the audio signal received via microphone 46 to voice recorder 40 for recording or to transceiver 54 for transmission to other base units 18 as well as to hybrid phone interface 34 and DAA 36 for transmission (via the telephone line) to monitoring station 16. Note that in the illustrated embodiment of the invention in which each of base unit 18 and pendant 22 has two such buttons, Panic button 53 on base unit 18 operates in the same way as Panic button 58 on pendant 22, and Talk button 48 on base unit 18 operates much in the same way as Community button 59 on pendant 22. Nevertheless, the channels that define the communication links established in response to pressing these buttons can be different, as described below.

Switch matrix circuit 43 also routes audio information received from pendant 22, a remote base unit 18, or monitoring station 16 to speaker 52. The user can adjust volume control 44 to set the loudness of the sound emanating from speaker 52.

Digital processor 30 has a timer through which it can synchronize actions in accordance with its programming. For example, as described in further detail below, base unit 18 can periodically (e.g., once per day, once per week, etc.) initiate a telephone call to a remote automated system and download software updates or configuration parameters into digital processor 30 or associated memory. The remote automated system associated with this download feature can be associated with and even integrated with monitoring system 16 as shown or, in other embodiments of the invention, can be a separate entity. During the call, the remote system can query base unit 18, upload logged information that may assist in analyzing security system performance or usage, or even disable or deactivate base unit 18. For example, it may be desirable for a monitoring service to deactivate base unit 18 if the homeowner who subscribes to the service has not timely paid a required monthly bill for the service or has tampered with base unit 18. This feature is described in further detail below with regard to FIGS. 6A–6C.

Base unit 18 can be powered through an external transformer-based power supply 78 that plugs into a household wall outlet (not shown) and provides a suitable DC voltage to base unit 18 through a jack 80. Jack 80 is coupled to a regulated power supply 82 that converts the voltage to that needed by the electronic circuitry. A backup battery 84 is coupled to power supply 82 to power unit 18 in the event household utility power fails. A recharger circuit 86 trickle-charges and floats battery 84 from utility power.

Suitable indicators, such as light-emitting diodes (LEDs) 88, 90, 92 and 93 can be included to indicate operational status. No Service LED 88 illuminates to indicate an error or trouble condition, such as the telephone line being unavailable, the monitoring service being cut off, or base unit 18 not being armed, i.e., set to monitor for an alarm. Low Battery LED 90 illuminates to indicate that battery 84 is almost completely discharged. Power LED 92 illuminates to indicate that unit 18 is powered by utility power. Panic LED 93 illuminates panic button 53 and blinks when the panic function has been activated by pressing panic button 53 or by base unit 18 receiving a signal from pendant 22 indicating that the corresponding panic button 58 on pendant 22 has been pressed. These indicator devices and their indication functions are contemplated in the illustrated embodiment of the invention, but operational indicators may be included for any suitable indication purpose or function in other embodiments.

Figure 4:
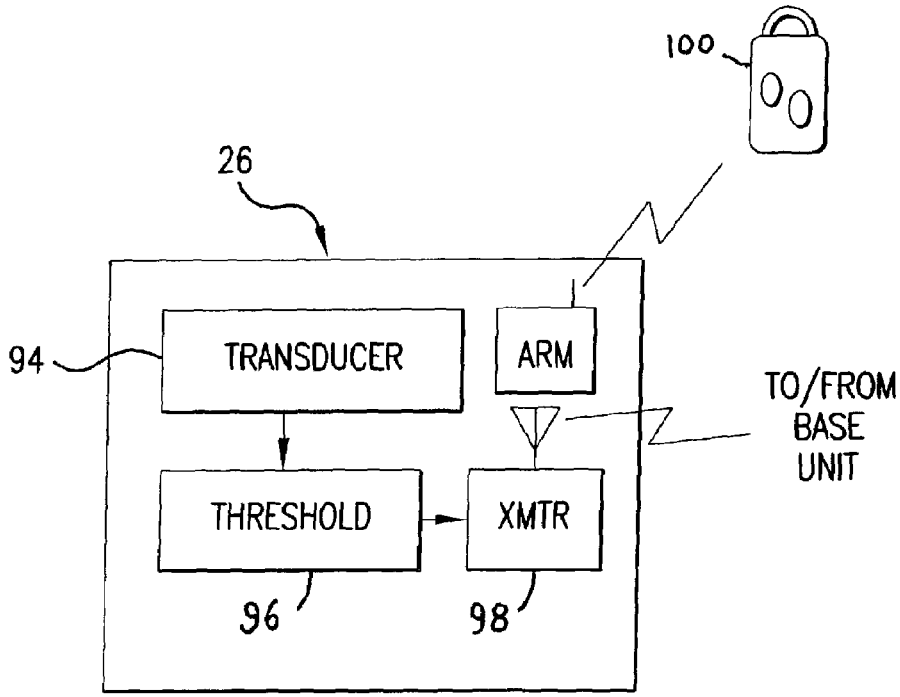
FIG. 4 is a block diagram of a movement detection device.

An embodiment of movement detection device 26 (FIG. 1) is further illustrated in block diagram form in FIG. 4. Device 26 includes a suitable transducer or sensor that can detect whether an object is being moved, such as a piezoelectric transducer 94. A threshold detector 96 compares the transducer signal to a predetermined level so as to filter out noise and otherwise minimize false alarms. Also included in device 26 is a suitable radio transmitter 98 that can transmit an activation signal to transceiver 62 in base unit 18 (FIG. 2) in response to the transducer signal exceeding the predetermined threshold. In response to this activation signal, base unit 18 activates the alarm. Included in the signal is information that identifies device 26 and distinguishes it from other such devices, such as an electronic serial number or an informational voice message. For example, the signal can be similar to that transmitted by pendant 22 in that it represents audio information and can inform the listener of the location of the moved object. For example, if device 26 is mounted on a boat trailer, the message can inform the listener that "The boat has been moved." Similarly, for example, if device 26 is mounted gate on the grounds of the monitored premises, the message can inform the listener that "The East Gate has been opened." The message can be pre-stored in voice recorder 40 in the same manner as the pre-recorded message described above with regard to activation of pendant 22. Alternatively to transmitter 98 transmitting audio information, it can transmit an electronic serial number or other unique identifier, in response to which digital processor 30 can cause a corresponding pre-recorded message such as those set forth above to be played for the listener. Depending upon how digital processor 30 is programmed in a given embodiment of the invention, it can cause the message to be played through speaker 52 in base unit 18 or, alternatively or in addition, transmitted to monitoring service 16 or a remote base unit 18.

A wireless movement sensor arm/disarm controller 100 transmits signals to device 26 in response to a user pressing one or more buttons controller 100 to arm or disarm device 26. In other words, pressing an Arm button can cause device 26 to respond to movement of the object by transmitting the activation signal, and pressing a Disarm button can cause device 26 to not respond to movement of the object.

Figure 5A:
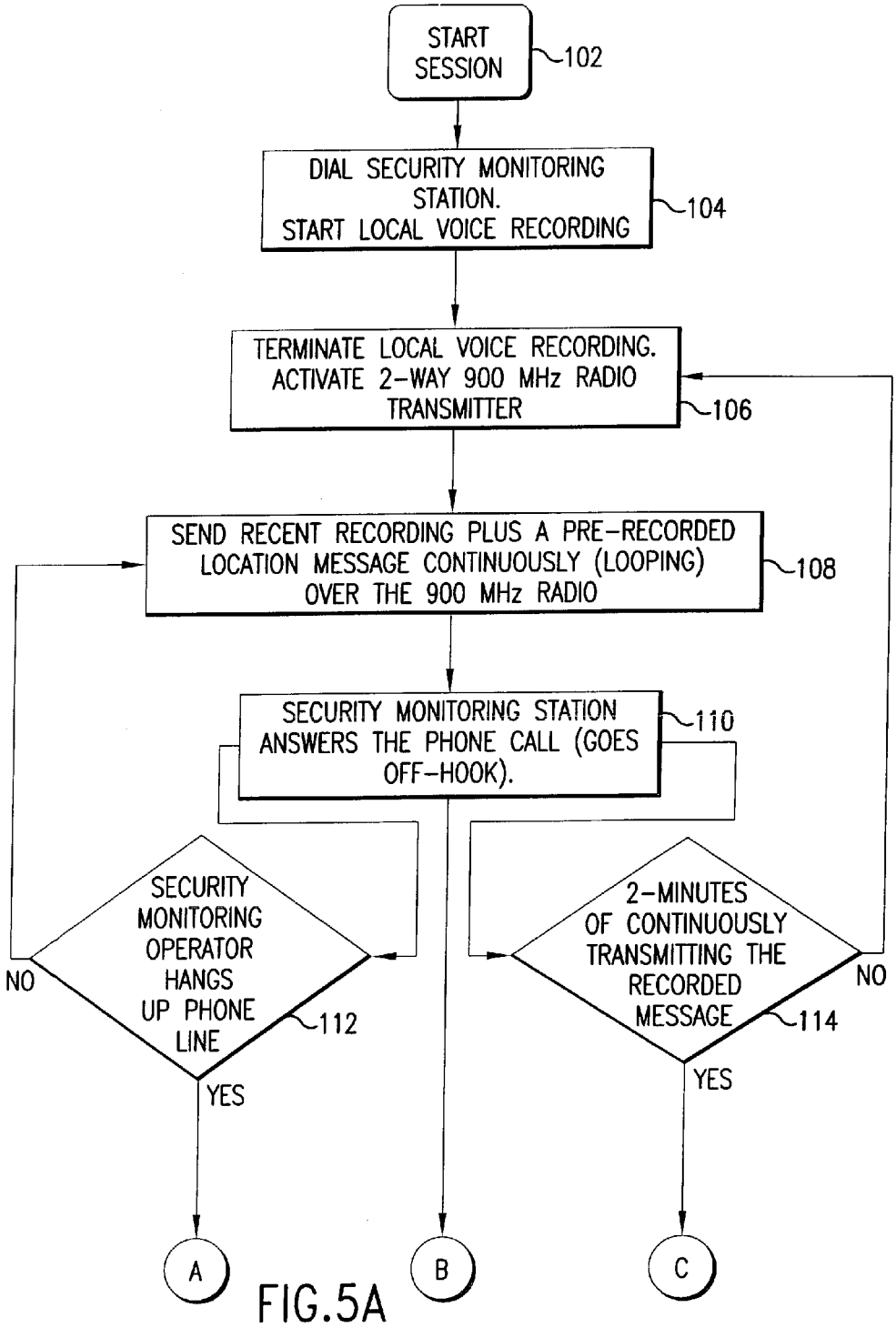
FIG. 5A is a portion of a flow diagram illustrating a method by which the security system can operate.
Figure 5B:
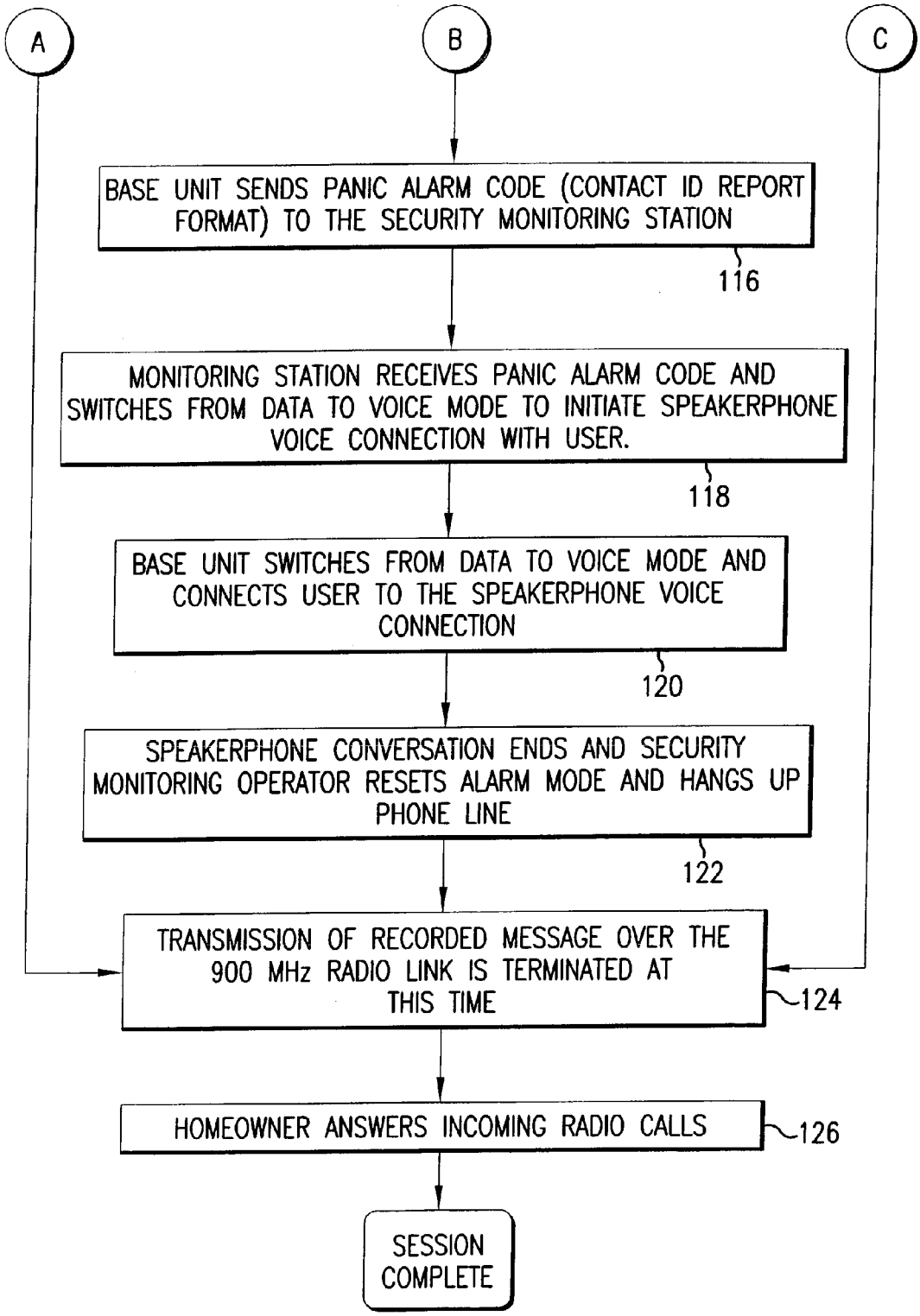
FIG. 5B is a continuation of the flow diagram of FIG. 5A.

A method of operation of the security system in one embodiment of the invention is illustrated in FIGS. 5A–B. Digital processor 30 can be programmed using suitable software and base unit 18 otherwise configured to effect these steps. Monitoring station 16 (FIG. 1) can be correspondingly programmed or configured. The steps are set forth in a certain order for purposes of illustration only, and unless explicitly stated otherwise, can be performed in any other suitable order.

Step 102 indicates that the alarm has been activated as a result of, for example, a person pressing Panic button 54 of base unit 18 (FIG. 2) or Panic button 58 of pendant 22 30 (FIG. 3). In response to the alarm activation, at step 104 digital processor 30 causes modem and DTMF generator 32 to dial a telephone number associated with monitoring station 16 and causes voice recorder 40 to begin recording any voice or other sound information it receives. As described above, if the activation occurred in response to the pressing of Panic button 54 of base unit 18, the sound information can be that gathered via microphone 46 of base unit 18. If the activation occurred in response to the pressing of Panic button 58 of pendant 22, the sound information can be that gathered via microphone 60 of pendant 22. Although any amount of sound information that recorder 40 is capable of storing can be recorded, a short interval such as five seconds is suitable.

At step 106, digital processor 30 causes voice recorder 40 to terminate recording and activate transceiver 54. At step 108, digital processor 30 causes voice recorder 40 to play the recorded sound plus a pre-recorded informational message. Digital processor 30 causes the played audio information to be transmitted via transceiver 54. This audio information can thus be heard by other persons at any other base unit 18 within reception range, such as at other houses in the neighborhood or community. The pre-recorded message may identify the monitored premises: "An emergency is occurring at; 123 Main Street." The recorded sound and pre-recorded message can be transmitted repeatedly to attract attention. As noted above, in other embodiments of the invention, the transmission may consist of only the pre-recorded message and not any recorded sound or, alternatively, only the recorded sound and not any pre-recorded message.

As described above, base unit 18 can alert not only neighbors but also monitoring station 16. Although illustrated as occurring after alerting neighbors, this step can occur before that of alerting neighbors or nearly simultaneously. At step 110, monitoring station 16 answers the telephone call placed by base unit 18. Personnel at monitoring station 16 can listen to the received audio information, until such time as personnel may hang up the telephone, i.e., terminate the telephone connection, or a predetermined length of time (e.g., two minutes) elapses, as indicated at steps 112 and 144, respectively.

At step 116, digital processor 30 causes contact I.D. codes to be sent to monitoring station 16 via the telephone connection. The contact I.D. codes identify the home or other monitored premises and may provide other information about the premises or nature of the emergency that monitoring service personnel can view on a computer screen (not shown). At step 118, monitoring station 16 receives the alarm identifier code and switches from a mode in which it can receive such data via the telephone line to a mode in which it can receive audio information via the telephone line. At step 120, digital processor 30 similarly causes base unit 18 to switch from a data mode to a voice mode. In the voice mode, an occupant of the home can speak with monitoring service personnel via the speakerphone feature of base unit 18 or pendant 22. Monitoring service personnel can also listen to sounds occurring in the home if there is no occupant with whom to speak. Step 122 indicates that monitoring personnel can terminate the telephone call and reset monitoring station 16 to monitor for further calls.

When the telephone connection is terminated, digital processor 30 causes transceiver 54 to cease transmitting audio information, as indicated by step 124. If the transmission of audio information for two minutes that is indicated by step 114 occurs without monitoring station 16 answering the telephone call during that time, digital processor 30 similarly causes transceiver 54 to cease transmitting at step 124.

As indicated by step 126, base unit 18 can receive transmissions of audio information from other base units 18 in the neighborhood. Note that step 126 is shown after the other steps for illustrative purposes only; such transmissions can be received at essentially any time. It is contemplated that wireless receiving devices (not shown) other than base unit 18 be made available to persons in the neighborhood or other persons, such as police and other emergency response personnel. Such receiving devices do not provide security but rather function only as receivers of audio information transmitted by base units 18.

Embodiments of the invention can include, in addition or alternatively to the features described above, a "system takeover" feature that allows base unit 18 to interface with an existing security system. For example, a homeowner may have been using a security system obtained from a company other than that which provides base unit 18 or its monitoring service. In such an instance, the existing security system can be retrofitted with base unit 18 by providing its telephone line signal to a pair of terminals 128 (FIG. 2) provided for this purpose. In this retrofitted configuration, the existing or other security system can continue to monitor various sensors and other activation devices that may be installed in the home, but if the other system's alarm is activated, base unit 18 detects that condition and alerts monitoring station 16. Base unit can detect the activation of another system's alarm by, for example, monitoring the telephone line signal for the Contact ID or other encoded signals generated by the other system with telephone line listening circuits 129. Listening circuits 129, which are sometimes referred to in the art as "snoop" circuits, can detect DTMF tones and Contact ID information without going off hook. Base unit 18, in effect, takes over the function of alerting a remote monitoring service from the existing security system. The homeowner can thus continue to use the sensors and other hardware associated with the existing security system and yet obtain the advantages described above with regard to the security system of the present invention.

Embodiments of the invention can include, in addition or alternatively to the features described above, a remote activation and remote control feature that allows a remote system to activate, program, configure, update and otherwise control base unit 18. This remote system may be referred to as a "remote provisioning system" for convenience because its functions can include activating, programming, configuring and updating base unit 18. As noted above, this remote provisioning system can be associated with monitoring system 16 in some embodiments of the invention or, in other embodiments, can be a separate entity. A method by which this feature can operate in one such embodiment is illustrated below in FIGS. 6A–6C.

Base unit 18 can be purchased from a retailer and, in most cases, installed by the homeowner or other user without the monitoring service personnel or anyone else visiting the home to assist with installation. For example, at step 130, after base unit 18 has been purchased, the user plugs it into household power and the telephone line. At that point, Power LED 92 (FIG. 2) becomes illuminated to indicate the presence of electrical power, and No Service LED 88 (FIG. 2) becomes illuminated to indicate that base unit 18 needs to be configured or activated through the remote system. At step 132, the user makes a conventional telephone call to the remote provisioning system and speaks with a provisioning operator. A toll-free number can be provided for this purpose. At that point, the user can speak with the provisioning operator through the speakerphone feature of base unit 18 and need not use a separate telephone, as indicated by step 134. At step 136, the user provides the operator with provisioning information, such as the serial number of base unit 18 and any optional devices (accessories) purchased, the user's name, address, credit card number, and any other information that may be necessary for the remote system to create an account for the user. The account is used in relation to billing the user for monitoring services and options. As noted above, the user can be billed (e.g., monthly) for the service of remotely monitoring the user's security system via base unit 18. The fee can vary, depending upon the features or options the user has selected. For example, pendant 22 can be an option or accessory to the basic security system, and a user can choose to have base unit 22 with or without pendant 22. Similarly, movement detection unit 26 can be an option to the basic system, and a user can choose to have base unit 22 with or without movement detection unit 26. The user can be charged for each option selected. A user can purchase base unit 18 and at a later time choose to add one or more options. If a user purchases an option, the user can call the remote provisioning system and have an operator activate the option as described herein. The user would thereafter be billed for the activated option.

After provisioning, the remote system can automatically activate or configure base unit 18. To enable activation, the provisioning operator instructs the user to press a provisioning button (137, FIG. 2), as indicated by step 138. This causes base unit 18 to go off-hook (i.e., ready for telephone line communication) at step 140. In the off-hook state, base unit 18 monitors modem and DTMF generator 32 for a command code received via the telephone connection. The command code is a unique code that indicates to base unit 18 that any codes that follow are to be interpreted as commands or configuration parameters. If, as indicated by step 142, no command code is received, indicating some problem or malfunction in the process, then at step 144 base unit 18 returns to the on-hook mode (i.e., hangs up the telephone call). The user can call again, as indicated at step 132.

Once base unit 18 detects a command code at step 142, at step 146 base unit 18 in response transmits a confirmation or verification code back to the remote system in a handshake-like manner. At step 148 base unit 18 stores the current time as a refresh time, as it may be necessary for base unit 18 to call the remote system for a refresh, as discussed below. Note that there are two instances in which base unit 18 communicates with the remote system: during the initial activation of base unit 18 when the homeowner or other user is initially installing it, and periodically thereafter to update, change, reconfigure or otherwise control base unit 18. If, at step 150, base unit 18 determines that it is being initially activated, then at step 152 it extinguishes No Service LED 88. Upon seeing LED 88 extinguish, the user releases Provisioning button 137 (which the user has been holding in a depressed or pushed state during the above-described initial activation steps).

At step 154, the remote system downloads parameter data into base unit 18 via the telephone line, and base unit 18 stores this data in non-volatile memory. As noted above, the parameter data can include data that enable and disable various features and options and can even disable base unit 18 entirely such that it will no longer operate in the normal manner described above. Such complete disablement may occur if, for example, the user has failed to pay monthly bills for the monitoring service. At step 156, base unit 18 updates Trouble LED 88, which would be illuminated if, for example, base unit 18 were disabled for non-payment of bills. The downloaded data can include a bit that controls whether Trouble LED 88 is illuminated as well as other bits that control various other circuit functions in base unit 18. The downloaded data can also include the refresh time, i.e., the next time that base unit 18 is to initiate a telephone call to the remote system. If base unit 18 determines that the download has been completed successfully, as indicated by step 158, then the process continues at step 160 with base unit 18 transmitting a confirmation or verification code back to the remote unit. If the download did not complete within some predetermined timeout period, such as a few minutes, then at step 162 base unit 18 goes off-hook and re-dials the remote system so that the download can be re-attempted, beginning at step 140. Note that because the then-current time was stored as the refresh time at step 148, the callback to the remote system at step 162 occurs immediately.

Figure 6A:
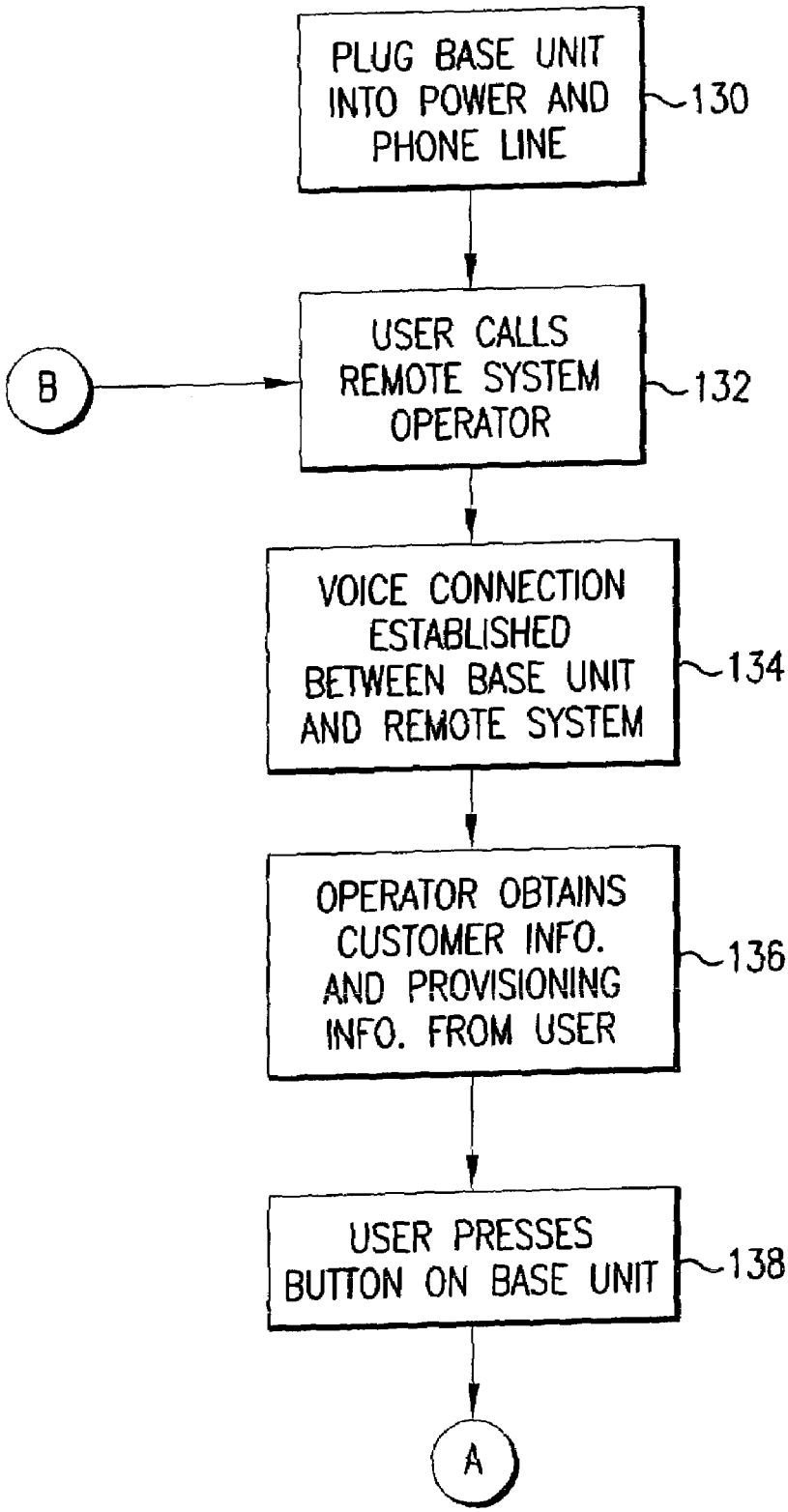
FIG. 6A is a portion of a flow diagram illustrating a method by which configuration and set-up parameters are communicated with a remote central station.
Figure 6B:
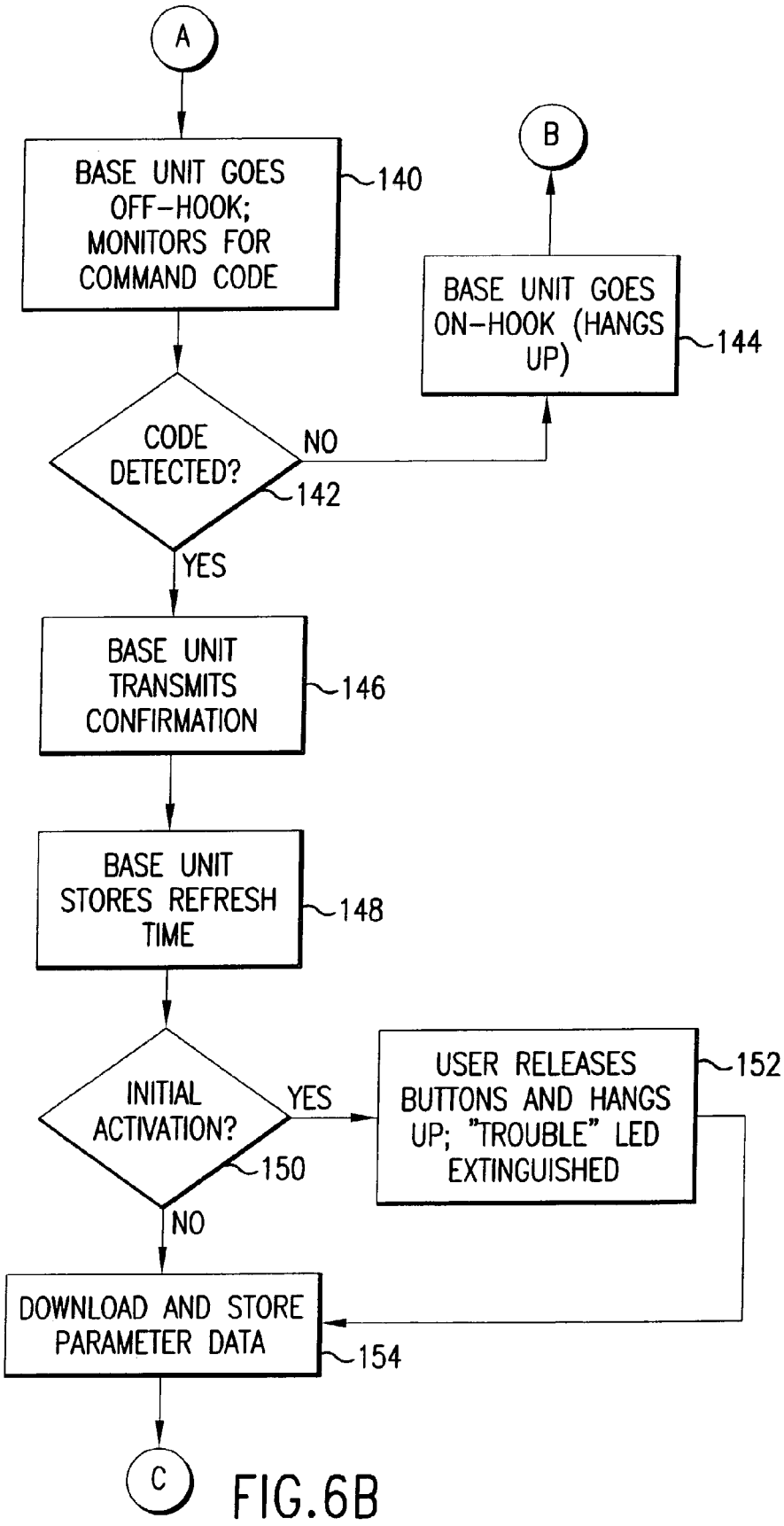
FIG. 6B is a continuation of the flow diagram of FIG. 6A.
Figure 6C:
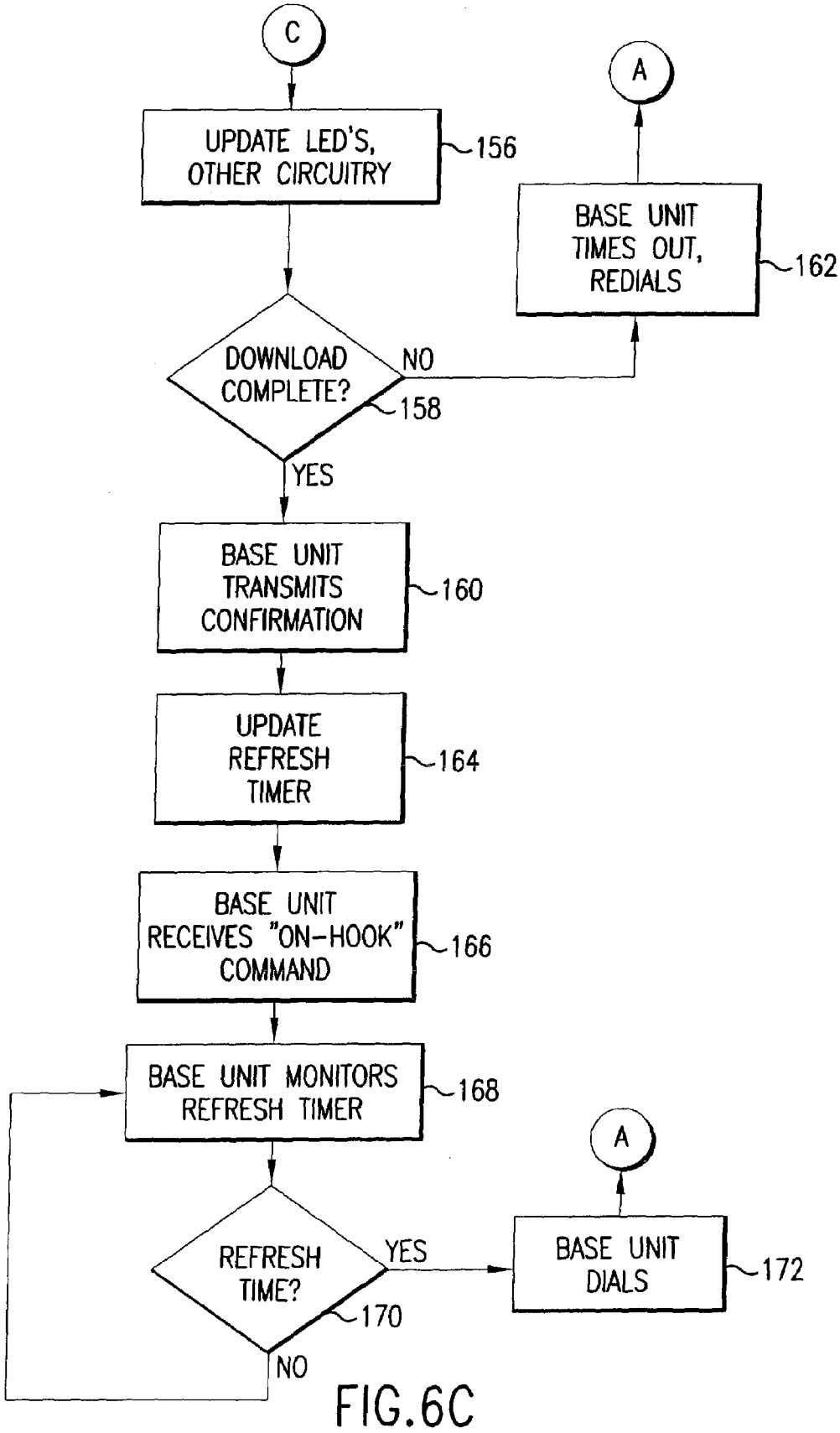
FIG. 6C is a continuation of the flow diagram of FIGS. 6A–B.

At step 164, base unit 18 updates the refresh timer with any newly downloaded refresh time. At step 166 base unit 18 receives from the remote system and executes a last command to go on-hook, i.e., to hang up the telephone call. With base unit 18 waiting in an on-hook state, it continuously monitors the refresh timer at step 168 until, as indicated by step 170, the current time is the refresh time. At that time, base unit 18 initiates a telephone call to the remote system as described above with regard to steps 140 et seq. Note that while base unit 18 monitors the refresh timer, it also monitors for alarm conditions as described above with regard to the flow diagram of FIGS. 5A–B. As persons skilled in the art to which the invention relates understand, the processes described herein with regard to these flow diagrams can occur essentially simultaneously and be effected through software and hardware structured in any suitable manner. The sequence of steps to which the invention may relate need not mirror those described above with regard to the flow diagrams. For example, although the flow diagram of FIGS. 5A–B and the flow diagram of FIGS. 6A–C are shown and discussed separately for purposes of clarity, the functionality they represent could be integrated. Similarly, it is understood by persons skilled in the art that the functionality could be further separated or redistributed among various processes in various suitable ways within the scope of the invention.

Embodiments of the invention can include a channel protocol. As illustrated in FIG. 7A, several base units 18 are located at residences or in other places (not shown) within a first neighborhood or community 172, several other base units 18 are within a second neighborhood or community 174, and still other base units 18 are within an area overlapped by both communities 172 and 174. As described above, in response to a person pressing Talk button 48 on base unit 18, a radio communication link is established between that base unit 18 and other base units 18 within reception range. In this manner, persons can use these base units 18 to converse with each other. In embodiments of the invention in which the channel protocol is included, these communication links are defined by a first channel. Channels can be defined in any suitable manner known in the art, such as by frequency division, time division, code division, etc. For example, in the illustrated embodiment, the frequency band is divided into different frequency channels, as indicated by the reference label "fa" (for frequency "a") in FIGS. 7A–D. Thus, FIG. 7A illustrates persons within community 174 conversing via channel fa.

Using Talk button 48 of base unit 18 to communicate between residences is given a lower priority than using Panic button 53 of base unit 18 or Panic button 58 of pendant 22 to summon help from monitoring station 16. As described above, in response to a person pressing Panic button 53 or 58, base unit 18 establishes communication with monitoring station 16 (via the telephone lines) as well as other base units 18 within radio reception range. Priority is implemented by having the communication links resulting from pressing Panic button 53 or 58 be on or defined by a second channel, as indicated by the reference label "fc" (for frequency "c") in FIGS. 7B–C.

Figure 7B:
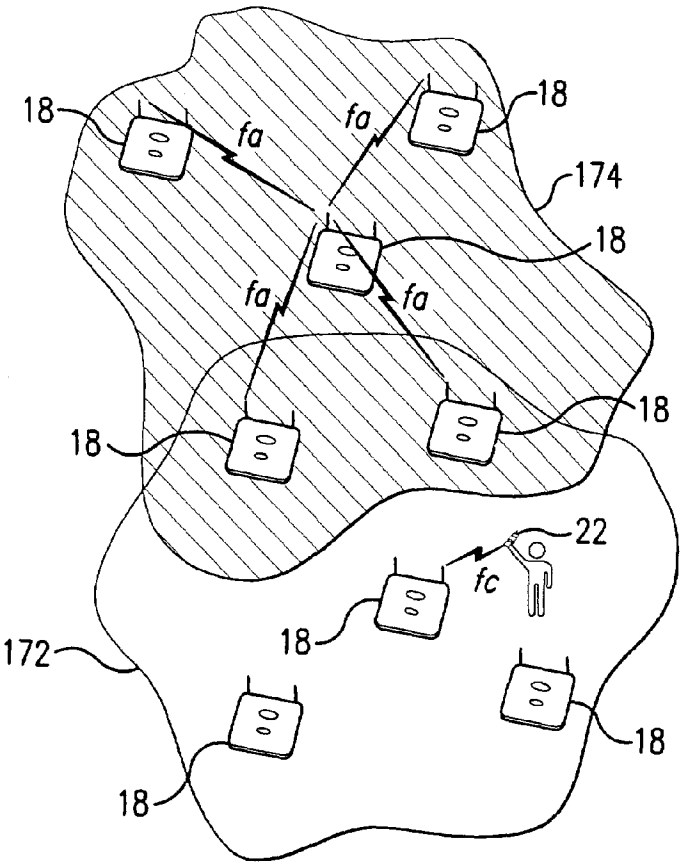
FIG. 7B is an illustration similar to FIG. 7B.
Figure 7A:
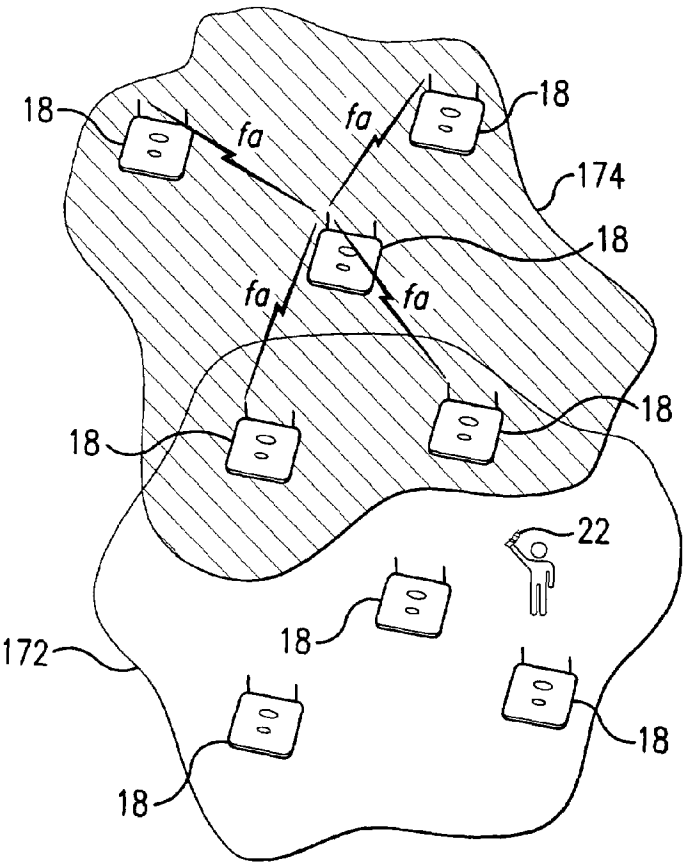
FIG. 7A illustrates operation of a communications channel protocol.
Figure 7C:
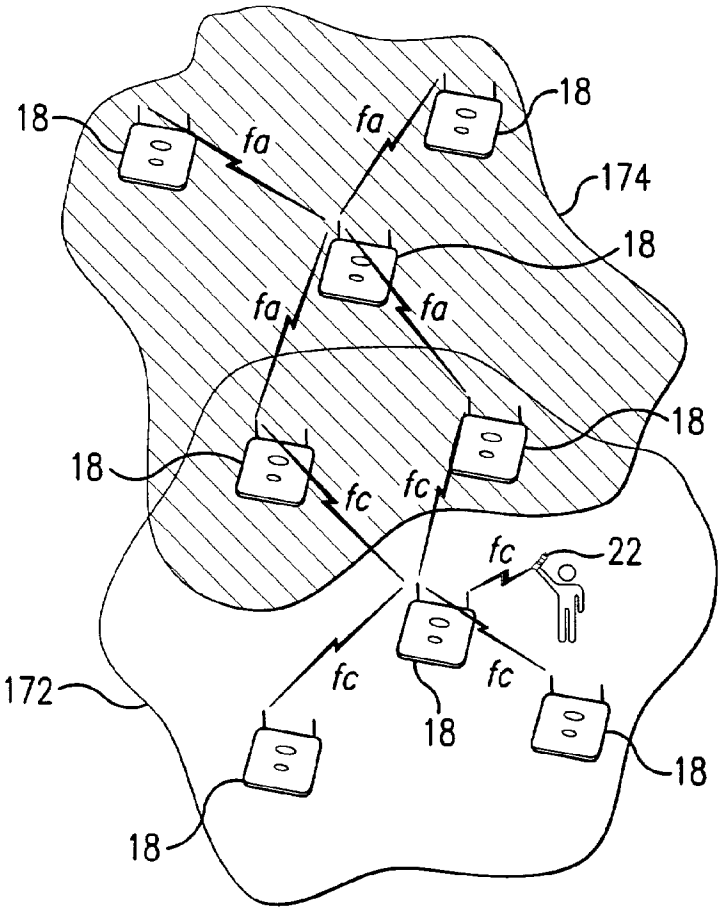
FIG. 7C is an illustration similar to FIGS. 7A–B.
Figure 7D:
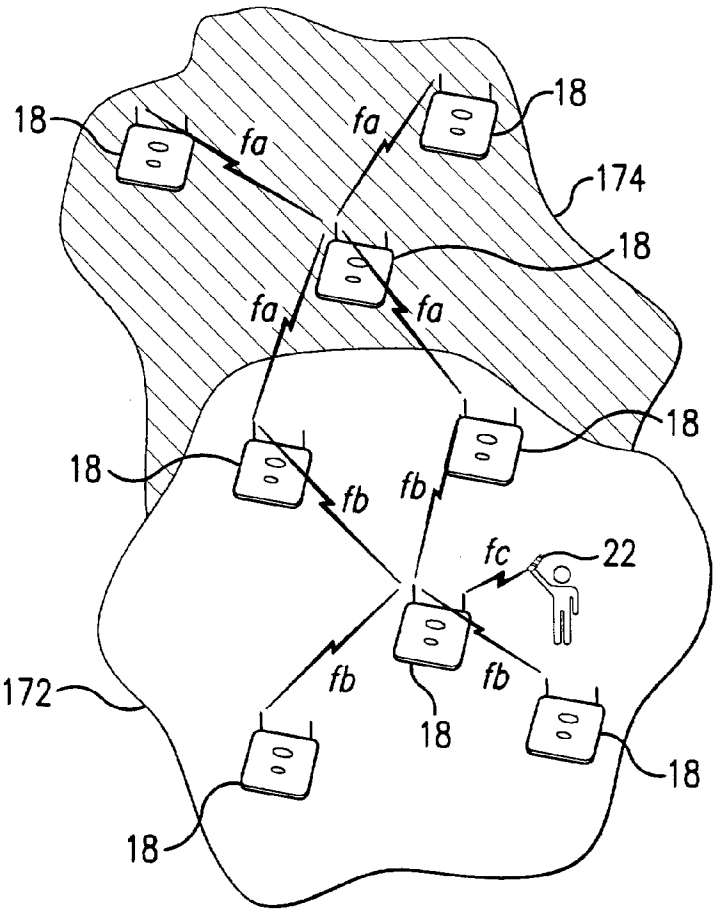
FIG. 7D is an illustration similar to FIGS. 7A–C.

For example, as illustrated in FIG. 7B, pressing Panic button 58 of pendant 22 establishes a communication link defined by the second channel, fc, between pendant 22 and an associated one of base units 18. As illustrated in FIG. 7C, in response, that base unit 18 establishes the telephone line communication link with monitoring station 16 and establishes communication links defined by the second channel, fc, with other base units 18 within reception range (presumably, though not necessarily, within the same community 172). In response to the establishment of the communication links between the base units 18, these base units 18 switch to a third channel, as indicated by the reference label "fb" (for frequency "b") in FIG. 7D. Meanwhile, persons in other communities, such as community 174, can continue to converse with one another via channel fa as described above.

The same operation occurs in response to a person pressing Panic button 53 of base unit 18. That is, a communication link defined by the second channel, fc, is established between that base unit 18 and other base units 18 within reception range. That base unit 18 also establishes the telephone line communication link with monitoring station 16. In response to the establishment of the communication links between the base units 18, these base units 18 switch to a third channel, as indicated by the reference label "fb" (for frequency "b") in FIG. 7D.

Pressing Community button 59 of pendant 22 establishes a communication link defined by the second channel, fc, between pendant 22 and an associated one of base units 18. In response, that base unit 18 establishes communication links defined by the second channel, fc, with other base units 18 within reception range. As described above, monitoring station 16 is not contacted. In response to the establishment of these communication links, base units 18 switch to the third channel, defined by frequency fb. Meanwhile, persons in other communities can continue to converse with one another via channel fa as described above.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A residential security system, comprising:

a plurality of base units, each having at least one activation input, a digital processor, a telephone line-based base unit communication interface, and a radio transceiver, the digital processor of a base unit programmed or adapted to initiate establishment of a radio communication link via the radio transceiver with said plurality of base units for transmission of audio information to the other of said plurality of base units simultaneously via the communication link in response to triggering of an activation input; and a monitoring system remotely located from the base units having a telephone line-based monitoring system communication interface, the digital processor of a base unit programmed or adapted to initiate establishment of a communication link with the monitoring system in response to triggering of an activation input.

2. The security system claimed in claim 1, wherein:

the radio transceiver is a half-duplex spread spectrum radio transceiver of a type selectably operable in either a simulated full-duplex time-division audio mode or a half-duplex continuous data mode; and to prevent ping-ponging problems, the processor directs digitally-encoded audio information received from the audio input to the radio transceiver in the data mode for transmission to the other of said plurality of base units via the communication link.

3. The security system claimed in claim 1, wherein the audio information includes a pre-programmed informational voice message.

4. The security system claimed in claim 3, wherein the informational voice message identifies a location of the base unit.

5. The security system claimed in claim 1, wherein the audio information is input from a microphone.

6. The security system claimed in claim 5, wherein the microphone is in or on the base unit.

7. The security system claimed in claim 5, wherein the microphone is in or on a portable wireless emergency activation unit associated with the base unit that is portable and activatable by an occupant of a premises monitored by the associated base unit.

8. A residential security system, comprising:

a plurality of base units, each having at least one activation input, a telephone line-based base unit communication interface, and a radio transceiver, one base unit programmed or adapted to initiate establishment of a radio communication link with the others of said plurality of base units in response to triggering of an activation input, the radio communication link communicating audio information simultaneously from the one base unit to the others;

a plurality of portable wireless emergency activation units, each associated with one of the base units and portable and activatable by an occupant of a premises monitored by its associated base unit, each emergency activation unit having a microphone receiving the audio information; and a monitoring system remotely located from the base units having a telephone line-based monitoring system communication interface, a base unit programmed or adapted to initiate establishment of a communication link with the monitoring system in response to triggering of an activation input, wherein the one base unit determines whether to establish a link between the one base unit and the others of said plurality of base units and monitoring system or between the one base unit and the others of said plurality of base units.

9. The security system claimed in claim 8, wherein:

each base unit is programmed or adapted to initiate establishment of a first communication link with the monitoring system and second communication links with other base units of the plurality of base units in response to triggering of a first activation input; and each base unit is programmed or adapted to initiate establishment of communication links with the other base units of the plurality of base units but not with the monitoring system in response to triggering of a second activation input.

10. The security system claimed in claim 9, wherein each base unit has a first button and a second button and is programmed or adapted to trigger the first activation input in response to pressing of the first button and programmed or adapted to trigger the second activation input in response to pressing of the second button.

11. The security system claimed in claim 9, wherein each portable wireless emergency activation unit has a first button and a second button, and each base unit is programmed or adapted to trigger the first activation input in response to a signal the portable wireless emergency activation unit transmits in response to pressing of the first button and programmed or adapted to trigger the second activation input in response to a signal the portable wireless emergency activation unit transmits in response to pressing of the second button.

12. A residential security system, comprising:

a plurality of base units, each having at least one activation input, a digital processor, a telephone line-based base unit communication interface, and a radio transceiver, one base unit programmed or adapted to initiate establishment of a radio communication link with said plurality of base units in response to triggering of an activation input, the radio communication link simultaneously communicating audio information from the one base unit to the others;

a plurality of movement detection units, each associated with one of the base units and mountable on an item of personal property associated with a premises monitored by its associated base unit, a movement detection unit transmitting an alarm activation signal to the base unit in response to detection of movement of the item; and a monitoring system remotely located from the base units having a telephone line-based monitoring system communication interface, a base unit programmed or adapted to initiate establishment of a communication link with the monitoring system in response to triggering of an activation input.

13. A method for alerting neighbors of an emergency event, comprising:

a first base unit of a plurality of base units detecting triggering of an activation input of the first base unit;

in response to detection of activation of an activation input, the first base unit initiating establishment of a radio communication link with the others of the plurality of base units, the base units located in residences in the same residential neighborhood;

in response to detection of activation of an activation input, the first base unit determining whether to establish a link between the first base unit and the-the others of the plurality of base units and the remote monitoring system or between the first base unit and the others of the plurality of base units;

the first base unit transmitting audio information to the others of said plurality of base units simultaneously via the radio communication link based on said determination; and the first base unit initiating establishment of a telephone line-based communication link with a remote monitoring system in response to triggering of an activation input based on said determination.

14. The method claimed in claim 13, wherein the step of detecting triggering of an activation input of the first base unit comprises detecting triggering of a panic button.

15. The method claimed in claim 14, wherein the panic button is included in the first base unit.

16. The method claimed in claim 14, wherein the panic button is included in a portable wireless emergency activation unit associated with the base unit.

17. The method claimed in claim 16, wherein:

detecting triggering of the panic button comprises detecting activation of the portable wireless emergency activation unit via a radio communication link defined by a first channel, all base units of the plurality of base units located in residences in the same residential neighborhood as each other and capable of communicating audio information with each other via a radio communication link defined by a second channel;

the step of the first base unit initiating establishment of a radio communication link with at least a second base unit of the plurality of base units comprises the first base unit initiating establishment of a radio communication link with one or more other of the plurality of base units; and in response to establishment of the radio communication link with the first base unit the one or more other of the plurality of base units becoming incapable of communicating audio information with each other via a radio communication link defined by the second channel and becoming capable of communicating audio information with each other via a radio communication link defined by a third channel.

18. The method claimed in claim 13, wherein the step of the first base unit transmitting audio information to the other of said plurality of base units comprises transmitting a predetermined informational voice message.

19. The method claimed in claim 18, wherein the informational voice message identifies a location of the first base unit.

20. The method claimed in claim 13, wherein the step of the first base unit transmitting audio information to the other of said plurality of base units comprises transmitting information representing sounds collected via a microphone.

21. The method claimed in claim 20, wherein the microphone is included in the base unit.

22. The method claimed in claim 20, wherein the microphone is included in a portable wireless emergency activation unit associated with the base unit.

23. The method claimed in claim 13, wherein the step of the first base unit transmitting audio information to the other of said plurality of base units comprises transmitting both a predetermined informational voice message and information representing sounds collected via a microphone.

24. The method claimed in claim 13, wherein the step of detecting triggering of an activation input of the first base unit comprises detecting triggering of a movement detector.

25. A method for alerting neighbors of an emergency event, comprising:

a first base unit of a plurality of base units detecting activation of a portable wireless emergency activation unit via a radio communication link defined by a first channel, all base units of the plurality of base units located in residences in the same residential neighborhood as each other and capable of communicating audio information with each other via a radio communication link defined by a second channel;

in response to detection of activation of the wireless emergency activation unit, determining an emergency type in order to determine whether communications with a remote monitoring system is required;

in response to detection of activation of the wireless emergency activation unit, the first base unit initiating establishment of a radio communication link with one or more other of the plurality of base units; and in response to establishment of the radio communication link with the first base unit the one or more other of the plurality of base units becoming incapable of communicating audio information with each other via a radio communication link defined by the second channel and becoming capable of communicating audio information with each other via a radio communication link defined by a third channel.

26. The method claimed in claim 25, wherein the first base unit initiates establishment of a telephone line-based communication link with the remote monitoring system in response to detection of activation of the wireless emergency activation unit.

27. A method for adding to an existing security system monitored by a first monitoring service the capability of alerting neighbors and a second monitoring service of an emergency event, comprising:

connecting a first base unit to a telephone connection monitored by the existing security system, the base unit having a digital processor, a telephone line-based communication interface, and a radio transceiver, the digital processor programmed or adapted to initiate establishment of a radio communication link via the radio transceiver with at least a second base unit for transmission of audio information to the second base unit via the communication link in response to triggering of an activation input, the digital processor further programmed or adapted to detect codes generated by the security system and destined for the first monitoring service and to transmit codes via a telephone line to the second monitoring service instead of the first monitoring service.

* * * * *